US005924263A

United States Patent [19]

Richardson

[11] Patent Number: 5,924,263

[45] Date of Patent: Jul. 20, 1999

[54] GLAZING BARS

[76] Inventor: Christopher Richardson, 4 Willow Drive, Clitheroe, United Kingdom, BB7 9FG

[21] Appl. No.: 09/003,987

[22] Filed: Jan. 7, 1998

[51] Int. Cl.[6] ..... E04C 3/30

[52] U.S. Cl. ..... 52/734.2; 52/314; 52/456; 52/734.1; 52/730.3; 52/730.4; 52/730.5; 52/730.6; 52/235; 52/94

[58] Field of Search ..... 52/314, 456, 734.1, 52/734.2, 730.3, 730.4, 730.5, 730.6, 235, 94

[56] References Cited

U.S. PATENT DOCUMENTS

| | | | |
|---|---|---|---|
| 1,090,303 | 3/1914 | Hester | 52/730.6 |
| 1,214,928 | 2/1917 | Lachman | 52/730.5 |
| 5,088,255 | 2/1992 | Emanuel | 52/456 |

FOREIGN PATENT DOCUMENTS

| | | |
|---|---|---|
| 323842 | 1/1930 | United Kingdom . |
| 752123 | 7/1956 | United Kingdom . |
| 808139 | 1/1959 | United Kingdom . |

*Primary Examiner*—Michael Safavi
*Attorney, Agent, or Firm*—Howell & Haferkamp, L.C.

[57] ABSTRACT

A glazing bar system for utilization within glass panel roofing. A support beam has upper and lower capping located thereon. An end cap is disposed along an end of the support beam so as to present a finished appearance when a lower end of the support beam is aligned along an eaves portion of a building structure. A bracket is secured to the end of the support beam by means of a screw inserted through a screw port of the support beam. The end cap having L-shaped projections forming two channels which allow the end cap to be slidingly engaged over ends of the bracket.

6 Claims, 2 Drawing Sheets

GLAZING BARS

This invention concerns improvements relating to glazing bars.

Glazing bars for constructing roofs of conservatories generally comprise aluminium support beams, between which are mounted glazing panels and upper and lower cappings to secure and seal the roofing panels and conceal the aluminium beams. Typical glazing beams are of inverted T-section with a channel shaped capping fitted to the cross bar of the T-section and an upper capping which has divergent sides and internally a means for connecting the upper capping to the top of the aluminium beam, usually in a press fit manner. Top ends of the glazing bars are concealed beneath ridge covers but their lower ends at the eaves of a conservatory structure need to be covered. At present an end cap is screwed to the aluminium glazing beam end, which is formed with a screw port for that purpose.

However, there are disadvantages with this system. Firstly, of course, the head of the screw or screws used to secure the end cap is or are unsightly, even when masked. Secondly, the screw or screws used are liable to corrosion and to allow water ingress into the glazing bar.

An object of this invention is to provide an improved system for securing end caps to glazing bars in order to avoid or mitigate against the above mentioned disadvantages.

According to the present invention there is provided a glazing bar system comprising a support beam, upper and lower cappings locatable on the beam, an end cap therefor, and means for mounting the end cap on the support beam end.

The means for mounting the end cap on the support beam end is preferably a bracket securable to the support beam end. The bracket is preferably securable to the end of the support beam by means of a screw through the bracket into a screw port of the support beam.

The bracket and the end cap preferably have mutually engageable formations whereby they slidingly interfit. One of the bracket and the end cap preferably provides a pair of facing channels and the other has a pair of oppositely facing lugs or the like which are a sliding fit in the channels.

The bracket preferably provides a pair of opposed ends or lugs spaced from the beam end to receive cooperating internal formations of the end cap in sliding relationship. The end cap preferably has a pair of opposed L-shaped projections on its internal face to provide said formations in the form of facing channels.

The end cap preferably has a rim that is deeper at its top, whereby the end cap when fitted covers the end of the upper capping.

The invention will now be further described, by way of example only, with reference to the accompanying drawings, in which.

Figures 1, 2:
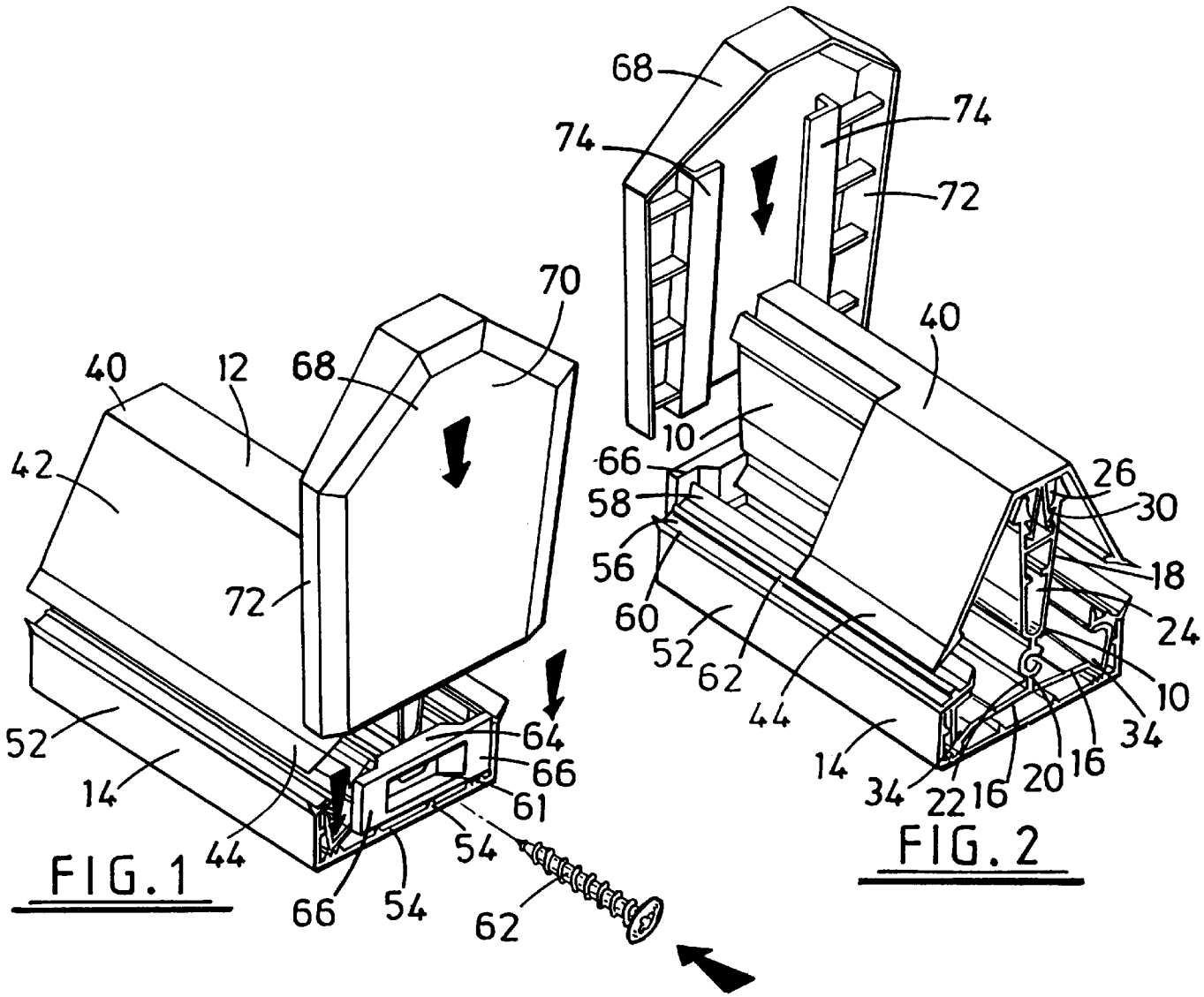
FIG. 1 is a front perspective view of a glazing bar system of the invention.
FIG. 2 is a rear view of the glazing bar system of FIG. 1.
Figure 3:
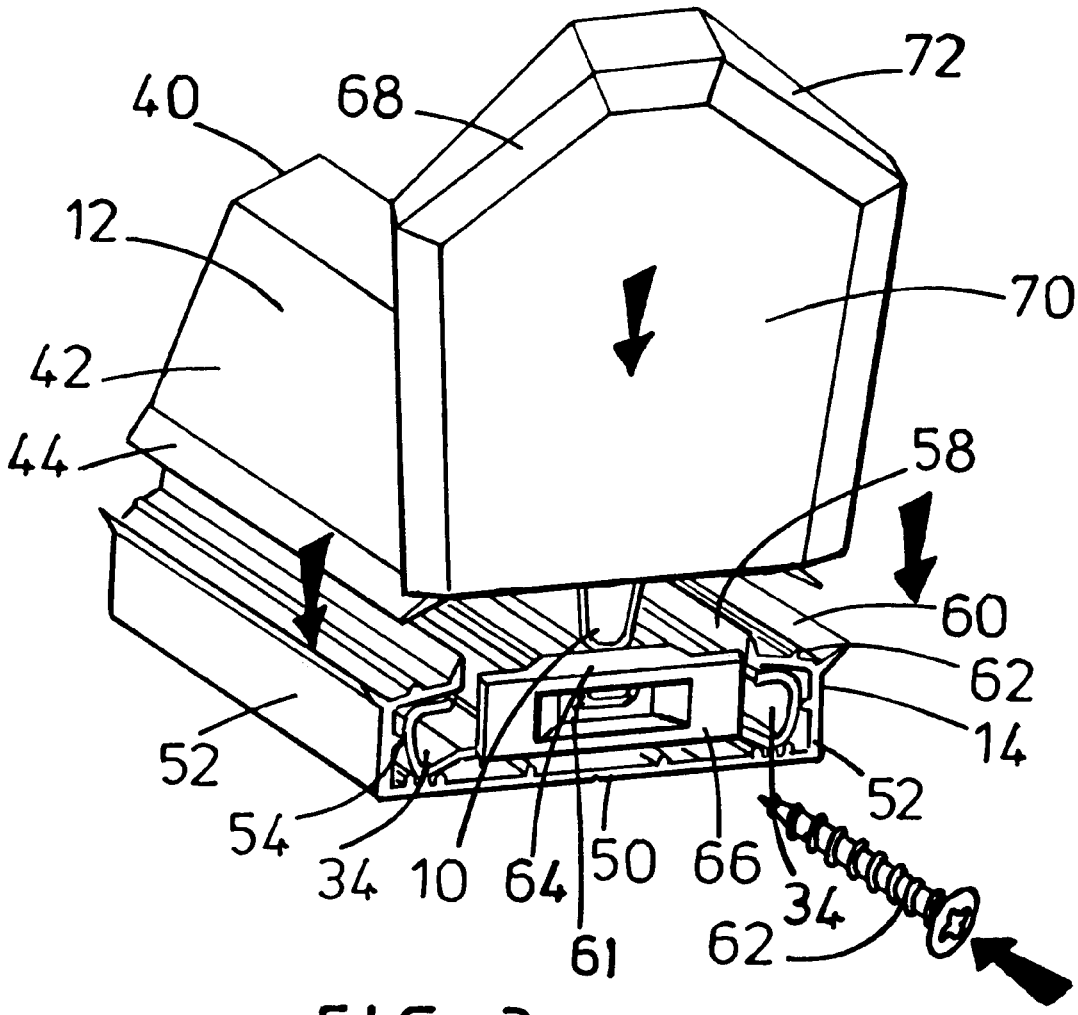
FIG. 3 is a further view of the glazing bar system of FIG. 1.

Referring to the accompanying drawings, a glazing bar system comprises a support beam 10 of aluminium and upper and lower cappings 12, 14 respectively of u-PVC. In use roofing panels, such as of transparent plastics material, for example polycarbonate, will have their edges sandwiched between the upper and lower cappings on opposite sides of the roof beam arrangement.

The support beam 10 is generally of inverted T-section. Thus, the beam 10 has a pair of flanges 16, which are turned back on themselves at their remote ends, and an upstanding limb 18. The limb 18 comprises a stem 20 extending from the junction of the flanges 16 to a screw port 22, a hollow generally triangular section main part 24 above the screw port and an upwardly open channel 26 above the main port. The channel 26 has generally parallel sides. On the inside of each side is a series of notches 30 forming downwardly open recesses.

Each flange 16 has a first part generally perpendicular to the upstanding limb 18 and a second part which forms a trough 34 remote from the upstanding limb 18. The upper capping 12 is generally of inverted V-section but comprises a flat top 40 and depending sides 42. The remote edges of the sides 42 have gaskets 44 formed thereon by co-extrusion of rubber or synthetic elastomeric material. Internally of the capping 12 and depending from its flat top 40 are a pair of resilient divergent flaps 46 having outwardly projecting tops 48 at their ends.

The lower capping 14 is generally formed as a channel section having a flat base 50 and upstanding side walls 52. Internally of the channel on the base 40 and on the side walls 52 are spacing projections 54. The free edges of the side walls 52 have co-extruded thereon, from rubber or synthetic elastomeric material, gaskets 56 which extend inwardly and are inclined slightly upwardly. The gaskets 56 include resiliently deformable projection 58 and 60 on their upper surface along their outermost edges and 62 centrally thereof.

To assemble a roof using the glazing bars, the aluminium support beams 10 are fixed in position between a ridge and the eaves of a conservatory roof. The lower cappings 14 are fitted onto the beams either before or after the beams are fixed in place. The glazing panels are positioned between the beams with their side edges on the gaskets 56, which are thereby trapped between the beam flanges and the glazing panels. Then the upper cappings are pressed down onto the beams with their deformable flaps being trapped in the upwardly open channels of the support beams.

At the end of the support beam 10 a bracket 61 is fixed by means of a screw 62 through the bracket into the screw port 22 of the support beam. The bracket 61 has a wider central section 64 and narrower opposed ends 66, whereby the ends are spaced from the end of the support beam. An end cap 68 for the glazing bar has a main surface 70 and a rim 72. On its intended inner face the end cap 60 has a pair of L-shaped projections 74 forming two facing open channels, which can be slid over the ends of the bracket to fit the end cap to the glazing bar.

The end cap rim 72 is of sufficient depth to extend rearwards over the ends of the upper and lower cappings. The rim widens to a central part 74 at the top of the cap, to ensure that the cap rests on the top of the upper capping when slid into place on the bracket.

Thus, the illustrated end cap provides a neat and simple to complete finish to the glazing bars for a conservatory roof.

I claim:

1. A glazing bar system comprising a support beam, upper and lower cappings locatable on the beam, an end cap therefor, and a bracket securable to an end of the support beam, wherein the bracket is securable to the end of the support beam by means of a screw through the bracket into a screw port of the support beam.

2. A glazing bar system comprising a support beam, upper and lower cappings located on the beam, a bracket secured to an end of the beam and an end cap for the beam, the end cap and the bracket having mutually engageable formations whereby they slidingly interfit.

3. A system as claimed in claim 2, wherein one of the bracket and the end cap provides a pair of facing channels and the other has a pair of oppositely facing lugs which are a sliding fit in the channels.

4. A system as claimed in claim 3, wherein the bracket provides a pair of opposed ends spaced from the beam end to receive cooperating internal formations of the end cap in sliding relationship.

5. A system as claimed in claim 3, wherein the end cap has a pair of opposed L-shaped projections on its internal face to provide said cooperating internal formations in the form of facing channels.

6. A system as claimed in claim 2, wherein the end cap has a rim that is deeper at its top, whereby the end cap when fitted covers the end of the upper capping.

* * * * *